US005503290A

United States Patent [19]

Gleichman

[11] Patent Number: 5,503,290

[45] Date of Patent: Apr. 2, 1996

[54] DETACHABLE COVER FOR WASTE BURNING RECEPTACLE

[76] Inventor: Mary S. Gleichman, Rte. 3, Box 298, Seminole, Okla. 74868

[21] Appl. No.: 344,975

[22] Filed: Nov. 25, 1994

[51] Int. Cl.[6] ..... B65D 51/16; B65D 51/04; F23G 5/00

[52] U.S. Cl. ..... 220/372; 220/334; 220/752; 126/224

[58] Field of Search ..... 312/283; 220/88.1, 220/908, 576, 334, 367, 369, 370, 371, 372, 373, 601, 730, 752; 126/224, 225, 223, 222

[56] References Cited

U.S. PATENT DOCUMENTS

| | | | |
|---|---|---|---|
| D. 246,566 | 12/1977 | Van Skiver | D7/194 |
| 1,761,428 | 2/1928 | Crary | 220/373 X |
| 1,928,914 | 8/1930 | Sparrow | 220/372 |
| 2,572,486 | 9/1949 | Isaac | 220/752 X |
| 3,091,357 | 9/1961 | Weinhart | 220/334 |
| 3,403,644 | 11/1966 | Heitz | 220/370 X |
| 3,450,297 | 6/1969 | Clerk | 220/334 X |
| 3,575,314 | 4/1971 | Ihlenfeld | 220/334 |
| 4,646,931 | 3/1987 | Andrews et al. | 220/320 |
| 5,083,671 | 1/1992 | Hayes | 220/339 X |
| 5,108,002 | 4/1992 | Rowan | 220/257 |
| 5,140,974 | 8/1992 | Whatley | 126/224 X |
| 5,154,308 | 10/1992 | Larson | 220/403 |
| 5,180,076 | 1/1993 | Hundt | 220/420 |

FOREIGN PATENT DOCUMENTS

| | | | |
|---|---|---|---|
| 1124474 | 7/1956 | France | 220/908 |
| 2412477 | 7/1979 | France | 220/908 |
| 2546772 | 4/1977 | Germany | 220/908 |
| 58286 | 9/1946 | Netherlands | 220/908 |
| 309501 | 11/1955 | Switzerland | 220/772 |

*Primary Examiner*—Stephen P. Garbe
*Assistant Examiner*—Nathan Newhouse
*Attorney, Agent, or Firm*—David L. Baker; Rhodes & Ascolillo

[57] ABSTRACT

A device for covering a trash burning receptacle, including a substantially planar, circular lid member. The lid member is composed of a heavy duty steel material and has a thickness of approximately ⅛ inch and a diameter of approximately 28 inches. A smoke exhaust stack is disposed on the top surface of the lid member, with the smoke exhaust stack including a cylindrically shaped steel pipe having a height of approximately four inches and a steel mesh grill disposed over its top surface. A securing mechanism pivotally attaches the lid member to the top of a cylindrical waste receptacle, and includes a U-shaped flange member removably attached to an outer edge of the waste receptacle, along with a hinge member having a first surface attached to the flange member and a second surface attached to the bottom surface of the lid member. In addition, a handle member is attached to the outside edge of the lid member such that the handle member and the hinge member are spaced apart by approximately 90 degrees with respect to the circular lid member.

7 Claims, 1 Drawing Sheet

DETACHABLE COVER FOR WASTE BURNING RECEPTACLE

BACKGROUND OF THE INVENTION

1. Field of the Invention

The present invention relates generally to a cover for a waste burning receptacle and, more particularly, to a cover providing adequate ventilation for proper incineration and which is detachable from the receptacle.

2. Description of the Related Art

U.S. Pat. No. 4,646,931 issued to J. Andrews and A. Andrews on Mar. 3, 1987 relates to a drum lid for an open head drum wherein the drum lid is secured to the drum by means of a closing ring for sealing the drum. A section of the lip of the drum lid is reinforced by securing a reinforcing member, such as a metal lug, to the exterior surface of the lid.

U.S. Pat. No. 5,108,002 issued to F. Rowan on Apr. 28, 1992 discloses a container cover for sealing containers, such as cylindrical drums. A removable protective sheet is adhered thereto in order to keep the cover during the filling and warehousing of the container.

U.S. Pat. No. 5,154,308 issued to D. Larson on Oct. 13, 1992 discloses a storage and transport drum including a cover and liner bag assembly, with the liner bag having bottom, side, and top walls. A collar surrounds an opening in the top wall and includes a groove for receiving a retainer ring within.

U.S. Pat. No. 5,180,076 issued to G. Hundt on Jan. 19, 1993 relates to a waste container having a cylindrical double-wall drum with separate spaced apart inner and outer sidewalls, as well as separate spaced-apart inner and outer bottom walls. In addition, a double-wall lid is provided to seal the container.

Trash burning is a common household chore in rural areas of the country, usually carried out in ordinary fifty gallon drums or other similar types of receptacles. On windy days, however, trash burning can become a dangerous activity as sparks and other burning particles may be swept out of the barrel. Therefore, a need exists for a device which effectively covers a trash burning receptacle, yet which also provides sufficient ventilation to allow the trash to be thoroughly incinerated.

SUMMARY OF THE INVENTION

Accordingly, it is a principal object of the present invention to provide a cover for a trash burning receptacle, thereby preventing sparks and other burning material from escaping from the receptacle.

It is a further object of the invention to provide such a cover which allows sufficient ventilation within the cover for proper incineration of trash material.

It is still a further object of the present invention to provide such a cover which is durable and which is easily detachable from a trash receptacle for multiple and repeated use.

The present invention achieves the above objects, among others, by providing in one aspect a device for covering a trash burning receptacle, including a substantially planar, circular lid member. The lid member is composed of a heavy duty steel material and has a thickness of approximately ⅛ inch and a diameter of approximately 28 inches. A smoke exhaust stack is disposed on the top surface of the lid member, with the smoke exhaust stack including a cylindrically shaped steel pipe having a height of approximately four inches and a steel mesh grill disposed over its top surface.

A securing mechanism pivotally attaches the lid member to the top of a cylindrical waste receptacle, and includes a U-shaped flange member removably attached to an outer edge of the waste receptacle, along with a hinge member having a first surface attached to the flange member and a second surface attached to the bottom surface of the lid member. In addition, a handle member is attached to the outside edge of the lid member such that the handle member and the hinge member are spaced apart by approximately 90 degrees with respect to the circular lid member.

Finally, a ventilation hole is located on the lid member for allowing air to circulate through the lid member and into the interior of the waste receptacle.

These and other objects, features, aspects and advantages of the present invention will become more apparent from the following detailed description of the present invention when taken in conjunction with the accompanying drawings.

DESCRIPTION OF THE PREFERRED EMBODIMENT

Figure 1:
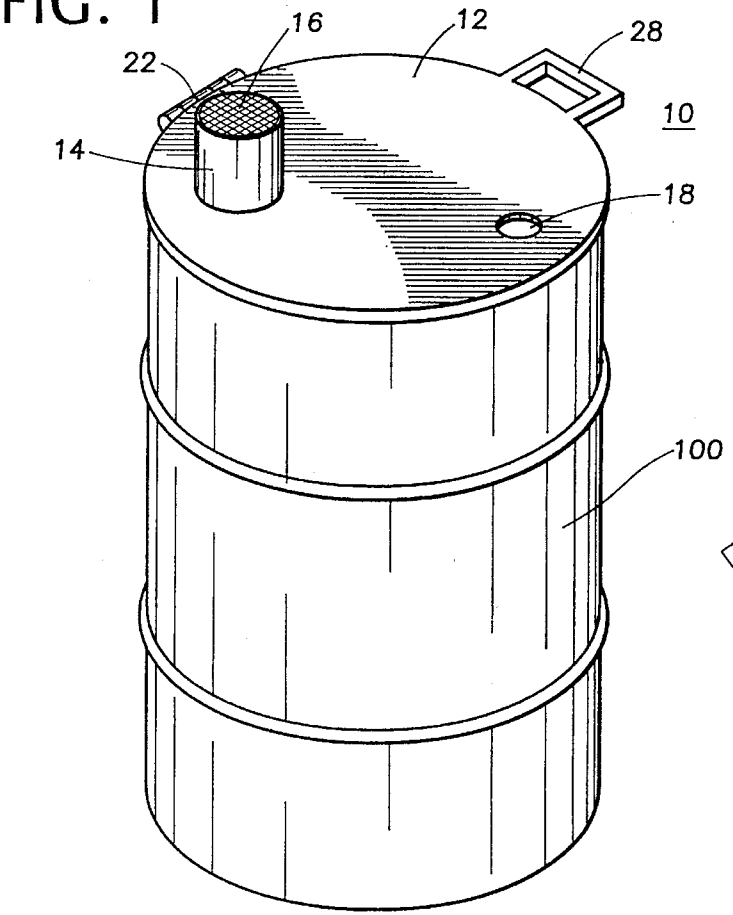
FIG. 1 is a perspective view of a cover for a trash burning receptacle, shown attached to the top of the receptacle according to the present invention.

Referring initially to FIG. 1, there is shown a cover for a trash burning receptacle, designated generally by the reference numeral 10. Cover 10 includes a generally circular shaped lid member 12, preferably fabricated from heavy duty steel material, having a thickness of approximately ⅛" and a diameter of approximately 28". In any case, the diameter of lid member 12 should be large enough to cover the opening of a standard fifty gallon waste receptacle 100. A cylindrically shaped, steel smoke exhaust stack 14 having a steel mesh grill 16 over the top thereof is attached to the top surface of the lid member 12 by conventional means, such as welding or brazing. Preferably, the inside diameter of the exhaust stack is approximately four inches, while the openings of the grill 16 are approximately ⅛".

The exhaust stack 14 allows smoke produced by the incineration of trash in the interior of the receptacle 100 to escape through an opening (not shown) in the lid member 12, and through the grill 16 without allowing pieces of burning trash to be swept out of the receptacle 100 during windy conditions. In addition, a ventilation hole 18 is also located on the surface of the lid member 12, preferably opposite the exhaust stack 14, in order to allow air to circulate through the interior of the waste receptacle 100 and facilitate the burning of trash. The ventilation hole 18 is preferably ½" in diameter, but this may be varied to be any suitable size which is small enough to prevent large pieces of burning trash from escaping the receptacle 100, but large enough to allow a sufficient quantity of air to pass therethrough.

Figure 2:
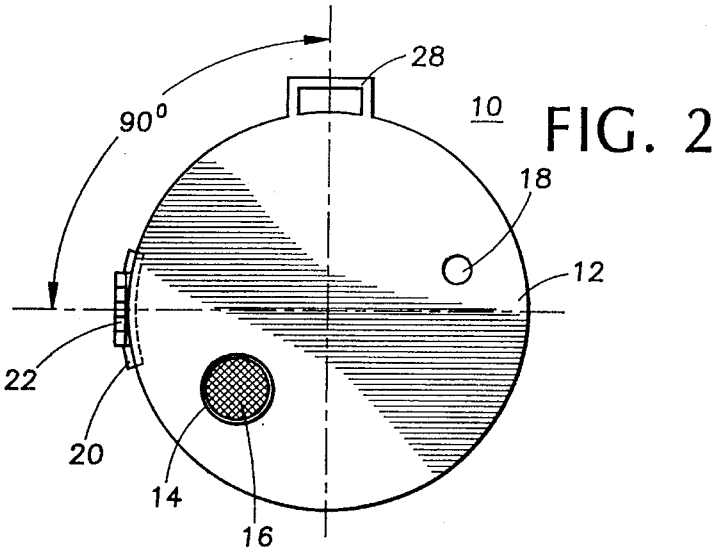
FIG. 2 is a plan view of the cover shown in FIG. 1.
Figure 3:
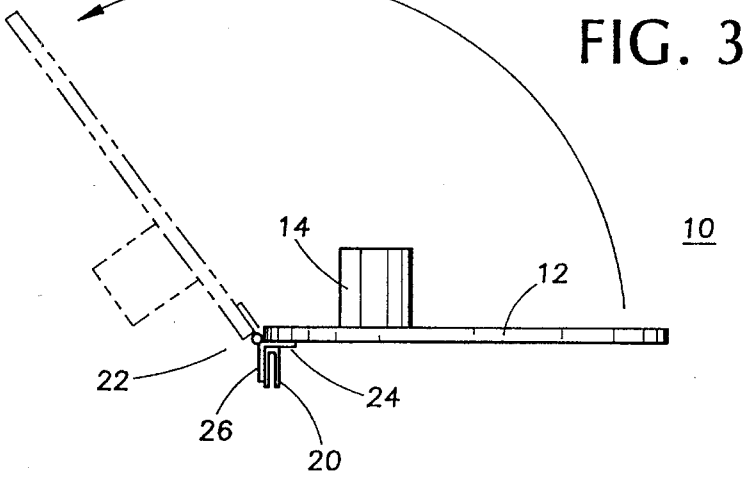
FIG. 3 is a side elevational view of the cover shown in FIG. 1, illustrating the pivoting motion of the cover about its hinge.

The present invention is designed to be removably attachable to an ordinary steel trash receptacle. As such, it includes a U-shaped flange member 20, as seen in FIGS. 2 and 3, which is slidingly engaged over the outer rim of the waste receptacle 100. FIG. 2 illustrates how the flange 20 includes a circular bend radius in order to fit over the circular outer rim. Cover 10 is attached to the flange 20 by means of a hinge member 22, which has a first surface 24 connected to the bottom surface of the lid member 12 and a second surface 26 connected to the outermost portion of the flange 20.

Finally, a handle 28 is provided along the outer edge of the lid member 12 so that a user may easily open and close the cover 10. As FIG. 2 illustrates, the handle 28 is positioned approximately 90 degrees apart from the hinge member 22. In this manner, a user may open the cover 10 from the side of the receptacle 100 without having his or her arm exposed over the flames generated inside the receptacle 100.

It should also be noted that the cover 10 may be painted black, and preferably with a fire retardant material, in order to increase the life of the cover. By doing so, the present invention will be capable of several years of use, as flange mounting makes it possible to transfer the cover 10 to another receptacle after the old receptacle wears out from repeated burning of trash within.

It will thus be seen that the objects set forth above, among those elucidated in, or made apparent from, the preceding description, are efficiently attained. Since certain changes may be made in the above construction without departing from the scope of the invention, it is intended that all matter contained in the above description or shown on the accompanying drawing shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A device for covering a trash burning receptacle, comprising:

a substantially planar, circular lid member;

a smoke exhaust stack, disposed on a top surface of the lid member, comprising a cylindrically shaped steel pipe having a height of approximately four inches;

a U-shaped flange member for removably attaching to an outer edge of the trash burning receptacle;

a hinge member having a first surface attached to the flange member and a second surface attached to a bottom surface of the lid member;

ventilation means in the lid member for allowing air to circulate through the lid member and into the interior of the waste receptacle, comprising a hole extending through the lid member and spaced from the smoke exhaust stack; and a steel mesh grill disposed across a top end of the smoke exhaust stack.

2. A device for covering a trash burning receptacle, comprising:

a substantially planar, circular lid member;

a smoke exhaust stack disposed on a top surface of the lid member, the smoke exhaust stack further comprising a cylindrically shaped steel pipe having a height of approximately four inches and a steel mesh grill disposed across a top end of the smoke exhaust stack;

a U-shaped flange member for removably attaching to an outer edge of the trash burning receptacle;

a hinge member having a first surface attached to the flange member and a second surface attached to a bottom surface of the lid member; and ventilation means, spaced from the smoke exhaust stack in the lid member for allowing air to circulate through the lid member and into the interior of the trash burning receptacle.

3. The device for covering a trash burning receptacle as described in claim 2 wherein the flange member has a circular bend radius to accommodate placement on the edge of the trash burning receptacle.

4. The device for covering a trash burning receptacle as described in claim 2, wherein the lid member is comprised of a heavy duty steel material.

5. The device for covering a trash burning receptacle as described in claim 4, wherein the lid member has a thickness of approximately ⅛ inch and a diameter of approximately 28 inches.

6. A device for covering a trash burning receptacle, comprising:

a substantially planar, circular lid member, comprising a heavy duty steel material and having a thickness of approximately ⅛ inch and a diameter of approximately 28 inches;

a smoke exhaust stack disposed on a top surface of the lid member, the smoke exhaust stack further comprising a cylindrically shaped steel pipe having a height of approximately four inches and a steel mesh grill disposed across a top end of the smoke exhaust stack;

a U-shaped flange member for removably attaching to an outer edge of the trash burning receptacle;

a hinge member having a first surface attached to the flange member and a second surface attached to a bottom surface of the lid member;

a handle member attached to the outside edge of the lid member; and ventilation means, spaced from the smoke exhaust stack, on the lid member for allowing air to circulate through the lid member and into the interior of the trash burning receptacle.

7. The device for covering a trash burning receptacle as described in claim 6, wherein the handle member and the hinge member are spaced apart by approximately 90 degrees with respect to the circular lid member.

* * * * *